US006958571B2

(12) United States Patent
Nishibayashi et al.

(10) Patent No.: US 6,958,571 B2
(45) Date of Patent: Oct. 25, 2005

(54) ELECTRON-EMITTING DEVICE

(75) Inventors: Yoshiki Nishibayashi, Suita (JP); Yutaka Ando, Suita (JP); Kiichi Meguro, Itami (JP); Takahiro Imai, Itami (JP)

(73) Assignees: Sumitomo Electric Industries, Ltd., Osaka (JP); Japan Fine Ceramics Center, Aichi (JP)

( * ) Notice: Subject to any disclaimer, the term of this patent is extended or adjusted under 35 U.S.C. 154(b) by 0 days.

(21) Appl. No.: 09/942,101

(22) Filed: Aug. 30, 2001

(65) Prior Publication Data

US 2002/0031913 A1 Mar. 14, 2002

(30) Foreign Application Priority Data

Aug. 31, 2000 (JP) ..... 2000-264374

(51) Int. Cl.[7] ..... H01J 19/24
(52) U.S. Cl. ..... 313/309; 313/336; 313/351
(58) Field of Search ..... 313/309, 495, 313/311, 336, 351, 310; 445/50, 51

(56) References Cited

U.S. PATENT DOCUMENTS

| | | | | |
|---|---|---|---|---|
| 5,199,918 A | | 4/1993 | Kumar | |
| 5,619,093 A | | 4/1997 | Glesener et al. | |
| 5,844,251 A | * | 12/1998 | MacDonald et al. | 313/336 |
| 5,869,169 A | * | 2/1999 | Jones | 313/310 |
| 5,916,005 A | | 6/1999 | Baik et al. | |
| 6,184,611 B1 | | 2/2001 | Saito et al. | |
| 6,762,543 B1 | * | 7/2004 | Kang et al. | 313/311 |

FOREIGN PATENT DOCUMENTS

| | | |
|---|---|---|
| EP | 0836217 A1 | 4/1998 |
| JP | 10-312735 | 11/1998 |
| JP | 10-204022 | 7/1999 |
| WO | WO 98/44529 | 10/1998 |
| WO | WO 00/79556 | 12/2000 |

OTHER PUBLICATIONS

K. Okano et al., "Mold growth of polycrystalline pyramidal–shape diamond for field emitters", Diamond and Related Materials 5, 1996, pp. 19–24, no month.

W.P. Kang et al., Micropatterned polycrystalline diamond field emitter vacuum diode arrays, American Vacuum Society, 1996, pp. 2068–2071, no month.

"Anisotropic etching of a fine column on a single crystal diamond" Nishibayashi et al., *Diamond and Related Materials*, Elsevier Science Publishers, Amsterdam, NL, vol. 10, NR. 9–10, pp. 1732–1735, ISSN: 0925–9635 7th International Conference on New Diamond Science and Technology, Jul. 23, 2000, Hong Kong, China.

"Diamond tip fabrication by air plasma etching of diamond with an oxide mask" Eun–Song Baik et al., *Diamond and Related Materials*, No. 8, 1999, pp. 2169–2171, XP002184096 no month.

"Homoepitaxial growth on fine columns of single crystal diamond for a field emitter" Yoshiki Nishibayashi et al., *Diamond and Related Materials*, No. 9, 2000, pp. 290–294, XP002184097 no month.

"Diamond 1999, the 10th European Conference on Diamond, Diamond–Like Materials . . . ", Sep. 12, 1999, Prague.

* cited by examiner

*Primary Examiner*—Joseph Williams
(74) *Attorney, Agent, or Firm*—McDermott Will & Emery LLP

(57) ABSTRACT

A method of manufacturing an electron-emitting element (20) for emitting electrons from diamond includes the first step of forming a diamond columnar member (25) on a diamond substrate (21), and the second step of forming an electron-emitting portion (30) having a base portion (36) and a sharp-pointed portion (32) which is located closer to a distal end side than the base portion (36) and emits the electrons by performing etching processing with respect to the columnar member (25).

5 Claims, 15 Drawing Sheets

| | DIMENSIONS OF COLUMNAR MEMBER | | DIMENSIONS OF ELECTRON-EMITTING PORTION | | |
|---|---|---|---|---|---|
| SAMPLE NO. | HEIGHT (μm) | DIAMETER (μm) | DIAMETER OF VERTEX PORTION(μm) | DIAMETER OF BASE (μm) | ASPECT RATIO |
| (1) | 3 | 3 | 0.5 | 2.6 | 1 |
| (2) | 5 | 5 | 3.5 | 4.5 | 1 |
| (3) | 8 | 8 | 6 | 7.5 | 1 |
| (4) | 4.2 | 3 | 0.5 | 2.6 | 1.4 |
| (5) | 7 | 5 | 0.5 | 4.5 | 1.4 |
| (6) | 7 | 3 | 0.5 | 2.6 | 2.3 |
| (7) | 11.5 | 5 | 0.5 | 4.5 | 2.3 |

5 μm

250nm

PRIOR ART

ELECTRON-EMITTING DEVICE

BACKGROUND OF THE INVENTION

1. Field of the Invention

The present invention relates to a method of manufacturing an electron-emitting element which can be applied to an electron gun, electron tube, vacuum tube, field-emission display (FED), and the like and an electronic device.

2. Related Background Art

With the recent advances in micropatterning techniques in the semiconductor technology, the field of vacuum microelectronics has undergone rapid development. A field-emission display (FED), in particular, has received a great deal of attention as one of the next-generation electronic deices having display functions. This is because the two-dimensional arrangement of microelectrodes serving as field-emission type electron-emitting elements in an FED, unlike a conventional CRT display, essentially eliminates the necessity of deflection/convergence of electrons to realize a flat display.

As a material used for microelectrodes of such an FED, diamond is in the limelight. This is because, diamond has negative electron affinity, which is a very effective property for an electron-emitting element. By forming microelectrodes using diamond, electrons can be emitted from the microelectrodes at a low voltage.

For example, as electron-emitting elements made of diamond, the elements disclosed in NEW DIAMOND, Vol. 13, No. 4, p. 28 (1997) and Japanese Patent Laid-Open No. 10-312735 are known. The former discloses an electron-emitting element formed by processing doped diamond in the shape of a needle (see FIG. 18). The latter discloses an electron-emitting element formed into a pyramidal shape by a diamond synthesis technique (see FIG. 19).

SUMMARY OF THE INVENTION

The above conventional electron-emitting elements, however, suffer the following problems. According to the former electron-emitting element, since each sharp-pointed electron-emitting portion in the shape of a needle is spontaneously formed by etching, the position of each electron-emitting portion cannot be controlled. According to the latter electron-emitting element, since the maximum height of each pyramidal electron-emitting portion is proportional to the length of its base, the height of the electron-emitting portion and the diameter of the emitter cannot be independently controlled. If, therefore, the area of the base of each pyramid is reduced to increase the density of pyramids, the height of each pyramid decreases. As a consequence, the electric field at the distal end portion of each pyramid decreases even while the voltage is kept unchanged. This makes it difficult to emit electrons.

The present invention has been made to solve the above problems, and has as its object to provide a method of manufacturing an electron-emitting element which allows the height and the area of the base of each electron-emitting portion to be independently controlled and also allows the formation position of each electron-emitting portion to be controlled, and an electronic device using the electron-emitting element manufactured by the method.

According to the present invention, there is provided a method of manufacturing an electron-emitting element for emitting electrons from diamond, comprising the first step of forming a diamond columnar member on a diamond substrate, and the second step of forming an electron-emitting portion having a base portion and a sharp-pointed portion which is located closer to a distal end side than the base portion and emits the electrons by performing etching processing with respect to the columnar member.

According to the method of manufacturing an electron-emitting element of the present invention, the position of each electron-emitting portion can be controlled by adjusting the place where a diamond columnar member is formed. An electron-emitting portion having a sharp-pointed portion on its distal end is formed by etching a columnar member. The area of the base of the completed electron-emitting portion depends on the area of the base of the columnar member before etching. The height of the electron-emitting portion depends on the height of the columnar member before etching and the type of etching. In addition, since the height and the area of the base of the columnar member can be set to desired values by adjusting the conditions of etching, the area of the base and height of the electron-emitting portion can be independently controlled unlike the case where the overall electron-emitting portion is formed into a pyramidal shape by a diamond synthesis technique as in the prior art.

In the method of manufacturing an electron-emitting element according to the present invention, the etching in the second step can be plasma etching.

In the method of manufacturing an electron-emitting element according to the present invention, in the second step, a portion of the diamond substrate other than a portion where the columnar member is preferably formed is masked, and reactive ion etching is preferably performed with respect to the columnar member. In this case, the sharp-pointed portion at the distal end of each electron-emitting portion can be formed into a needle-like shape.

In the method of manufacturing an electron-emitting element according to the present invention, in the first step, the diamond substrate is preferably etched after a circular mask portion is formed on a surface of the diamond substrate, and in the second step, the electron-emitting portion is preferably formed by performing etching with respect to the columnar member with a ratio of an etching rate in a lateral direction to an etching rate in a longitudinal direction being higher than that in the etching in the first step.

In this case, in the first step, the position of each electron-emitting portion can be controlled by adjusting the place where each circular mask portion is formed. In addition, since the etching rate in the lateral direction is increased in the second step, a sharp-pointed portion can be formed at the distal end of each columnar member. The area of the base of the obtained electron-emitting portion depends on the area of the base of the columnar member obtained by etching in the first step, and the height of the electron-emitting portion depends on the etching conditions in the first and second steps. The area of the base of the columnar member can be controlled by adjusting the area of the mask portion. The height of the electron-emitting portion can be controlled by adjusting the amount of portion of the diamond substrate which is removed by the etching in the first step. Therefore, the height and the area of the base of the electron-emitting portion can be independently controlled.

According to the present invention, there is provided another method of manufacturing an electron-emitting element for emitting electrons from diamond, comprising the first step of forming a diamond columnar member on a diamond substrate, and the second step of forming an electron-emitting portion having a base portion, a sharp-pointed portion for emitting the electrons, and a columnar intermediate portion located between the base portion and the sharp-pointed portion by performing diamond synthesis processing with respect to the columnar member.

According to the method of manufacturing an electron-emitting element of the present invention, the position of each electron-emitting portion can be controlled by adjusting the place where a diamond columnar member is formed. An electron-emitting portion having a base portion, intermediate portion, and sharp-pointed portion is formed by performing diamond synthesis processing with respect to a columnar member. The area of the base of the obtained electron-emitting portion depends on the shape of the columnar member before diamond synthesis processing. The height of the electron-emitting portion depends on the shape of the columnar member before diamond synthesis processing and the conditions of diamond synthesis processing. In addition, since the height and the area of the base of the columnar member can be set to desired values by adjusting the conditions of etching, the area of the base and height of the electron-emitting portion can be independently controlled unlike the case where the overall electron-emitting portion is formed into a pyramidal shape by a diamond synthesis technique as in the prior art.

According to the present invention, there is provided an electronic device comprising an electron-emitting element manufactured by each method described above, and an electron extraction electrode placed to oppose the sharp-pointed portion, with a voltage being applied between the electron extraction electrode and the electron-emitting element.

According to the electronic device of the present invention, electrons are emitted from the sharp-pointed portion of each electron-emitting portion toward the electron extraction electrode by applying the voltage between the electron extraction electrode and the electron-emitting portion.

The electronic device according to the present invention includes a metal gate electrode formed around the base portion of the electron-emitting element, and a power supply for applying a voltage to the gate electrode.

When the above arrangement is employed, a Schottky junction is formed on a portion where a metal gate electrode is formed, and a depletion layer is formed inside the base portion. The size of the depletion layer can be controlled by adjusting the voltage applied to the gate electrode. As the depletion layer increases, the number of electrons emitted from the sharp-pointed portion decreases, and vice versa. Note that even if an insulating layer is formed between the gate electrode and the base portion to form a MIS junction, the number of electrons emitted can be adjusted.

The present invention will become more fully understood from the detailed description given hereinbelow and the accompanying drawings which are given by way of illustration only, and thus are not to be considered as limiting the present invention.

DETAILED DESCRIPTION OF THE PREFERRED EMBODIMENTS

Figure 1A:
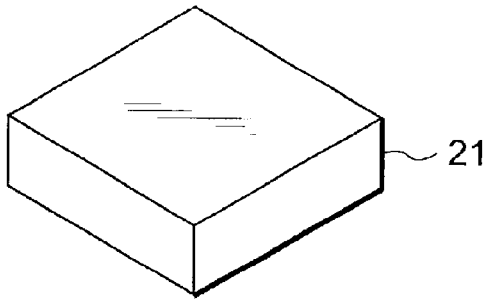
FIGS. 1A to 1E are perspective views showing the steps in a method of manufacturing an electron-emitting element according to the first embodiment of the present invention.
Figure 1B:
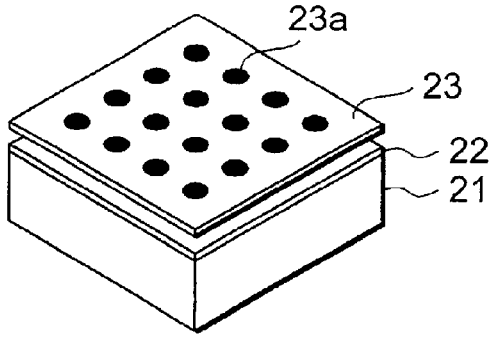

The preferred embodiments of the method of manufacturing an electron-emitting element and the electronic device according to the present invention will be described below. Note that the same reference numerals denote the same parts, and a repetitive description thereof will be avoided.

[First Embodiment]

FIGS. 1A to 1E are views showing the steps in a method of manufacturing an electron-emitting element according to the first embodiment of the present invention. First of all, a substrate 21 made of Ib monocrystalline diamond whose surface is the {001} plane like the one shown in FIG. 1A is prepared. In the step shown in FIG. 1B, a resist layer 22 is formed on the substrate 21, and a photomask 23 on which circular light-shielding plates 23*a* are two-dimensionally formed is placed on the resist layer 22. The pitch of the light-shielding plates 23*a* of the photomask 23 is set to, for example, about 1 $\mu$m to 50 $\mu$m. Two-dimensional patterns are formed on the resist layer 22 at positions corresponding to the light-shielding plates 23*a* of the photomask 23 by a photolithographic technique.

Figure 1C:
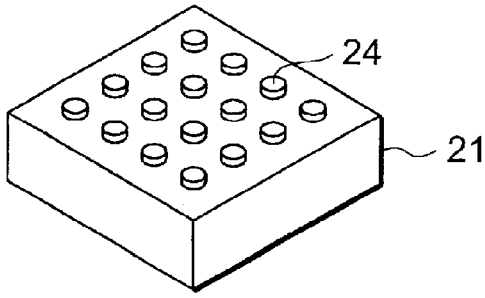
Figure 1D:
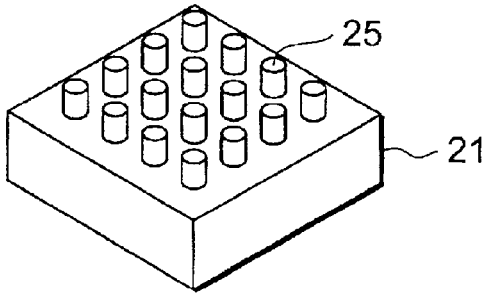

In the step shown in FIG. 1C, mask portions 24 corresponding to the above patterns on the resist layer 22 are formed by an etching technique. In the step shown in FIG. 1D, a plurality of columnar members 25 made of monocrystalline diamond are formed on the substrate 21 by RIE (Reactive Ion Etching). In this embodiment, each columnar member 25 has a circular cross-section. However, for example, it may have a rectangular or triangular cross-section. In addition, each columnar member 25 preferably has a height of about 1 $\mu$m to 20 $\mu$m and a diameter of about 0.5 $\mu$m to 10 $\mu$m. The ratio of the height to the diameter of each columnar member 25 (to be referred to as an "aspect ratio" hereinafter) is preferably about 1 to 5.

The reason why reactive ion etching is used to form the columnar members 25 is that the projection-like columnar members 25 can be easily formed, and portions other than the portions on which the columnar members 25 are formed can be smoothly etched. Note that a reactive gas used for reactive ion etching is preferably $O_2$ alone or a gas mixture of $CF_4$ and $O_2$.

A technique other than reactive ion etching may be used to form the columnar members 25. For example, ion beam etching, ECR (Electron Cyclotron Resonance) etching, or etching using ICP (Inductive Coupled Plasma) can be used.

Figure 1E:
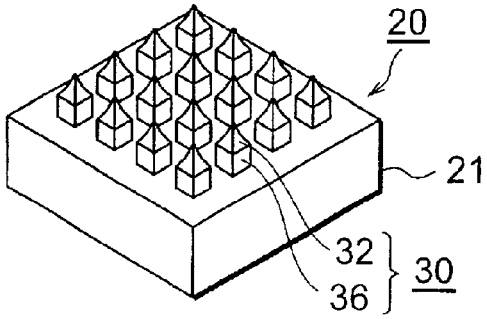
Figure 2:
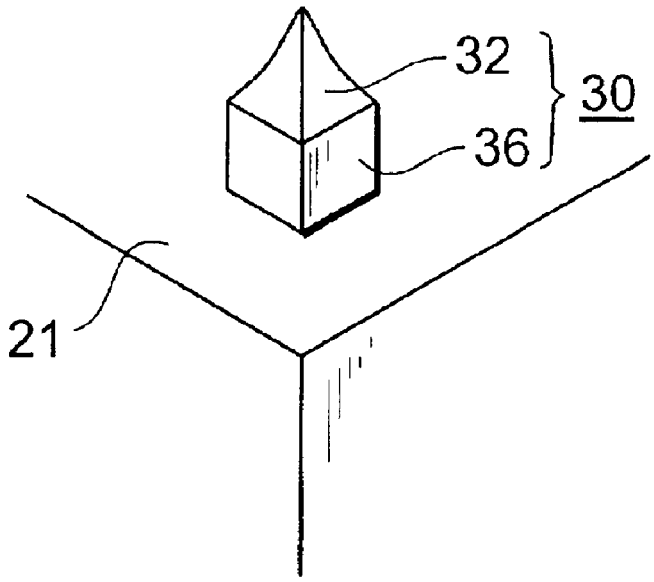
FIG. 2 is an enlarged view of an electron-emitting portion in FIG. 1E.

In the step shown in FIG. 1E, plasma etching is performed for the columnar members 25 in a microwave plasma to form electron-emitting portions 30. FIG. 2 is an enlarged view of the electron-emitting portion 30. As shown in FIG. 2, the electron-emitting portion 30 has a prismatic base portion 36 and a sharp-pointed portion 32 located closer to the distal end side than the base portion 36. The reason why the base portion 36 is formed into a prism (quadrangular prism in this case) is that the surface of the substrate 21 is the {001} plane. When a voltage is applied to an electron-emitting element 20, electrons are emitted from the distal end of each sharp-pointed portion 32.

Plasma etching is preferably performed in a 100% oxygen gas, at a reactive chamber temperature of room temperature to about 200° C., and a pressure of 0.1 to 40 Pa (preferably near 5 Pa, in particular) in the reactive chamber, or in a gas mixture of $CF_4$ (mol)/$O_2$ (mol)$\leqq$about 0.25, at a reactive chamber temperature of room temperature to about 200° C., and at a pressure of 0.1 to 40 Pa (preferably near 5 Pa, in particular) in the reactive chamber. In addition, plasma etching may be performed in a plasma other than the microwave plasma, for example, a DC plasma, arc jet plasma, or flame plasma.

According to the method of manufacturing the electron-emitting element 20 of this embodiment, the position of each electron-emitting portion 30 can be controlled by adjusting the place where each diamond columnar member 25 is formed. That is, the electron-emitting portion 30 can be formed at a desired position. In addition, the area of the base of the electron-emitting portion 30 formed by plasma etching depends on the area of the base of the columnar member 25 before etching, and the height of the electron-emitting portion 30 depends on the height of the columnar member 25 before etching and the type of etching. In addition, since the height and the area of the base of the columnar member 25 can be set to desired values by adjusting the conditions of reactive ion etching, the area of the base and height of the electron-emitting portion 30 can be independently controlled unlike the case where the overall electron-emitting portion 30 is formed into a pyramidal shape by a diamond synthesis technique as in the prior art. For this reason, if the aspect ratio of each columnar member 25 is set to be high, the density of electron-emitting portions 30 in the electron-emitting element 20 can be increased without decreasing the height of each electron-emitting portion 30, i.e., decreasing the number of electrons emitted upon a drop in voltage applied to the distal end portion of each electron-emitting portion 30.

In this embodiment, the substrate 21 made of monocrystalline diamond is used. However, a hetero-epitaxial diamond substrate or highly oriented film substrate may be used. If a highly oriented film substrate is used, the particle size is preferably set to be larger than the diameter of each columnar member 25 to prevent one columnar member 25 from including a plurality of particles. Although the characteristics of an electron-emitting element slightly deteriorate, a substrate may be formed by polycrystalline diamond with various plane azimuths. In addition, the substrate 21 is not limited to a (100) substrate, a (110) substrate or (111) substrate may be used.

Figure 3A:
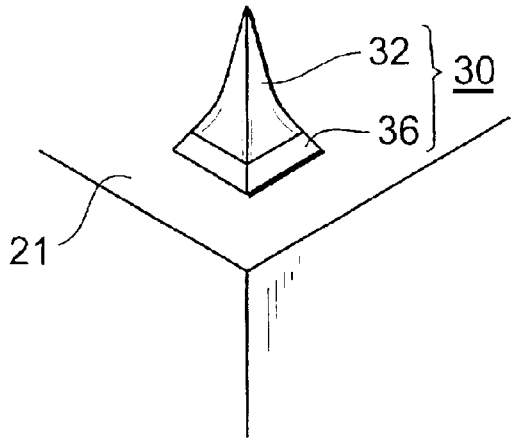
FIGS. 3A and 3B are perspective views showing modifications of the electron-emitting element according to the first embodiment.
Figure 3B:
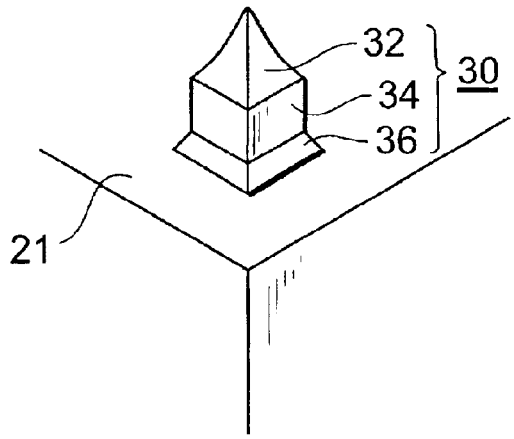

FIGS. 3A and 3B are perspective views showing modifications of the electron-emitting element 20 of this embodiment. In each modification, the shape of the electron-emitting portion 30 differs from that of the electron-emitting portion 30 in FIG. 2. The electron-emitting element in FIG. 3A is formed into a frustum of a quadrangular pyramid instead of a quadrangular prism. In the electron-emitting element in FIG. 3B, an intermediate portion 34 in the shape of a quadrangular prism is formed between the base portion 36 in the shape of a frustum of a quadrangular pyramid and the sharp-pointed portion 32. The shape shown in FIG. 3A can be formed from a very thin columnar member (with a diameter of less than 1 $\mu$m) under etching conditions including methane. The shape shown in FIG. 3B can be formed from a general columnar member (with a diameter of 1 $\mu$m or more) under etching conditions including methane.

In addition, low index planes tend to appear on the intermediate portion 34 and base portion 36 of the electron-emitting portion 30 obtained in this embodiment. For this reason, a Schottky junction having a diamond/metal structure can be formed by depositing a metal on the intermediate portion 34 or base portion 36 on which a low index plane appears Alternatively, a MIS junction having a diamond/insulator/metal structure can be formed by depositing an insulator/metal on the intermediate portion 34 or base portion 36 on which a low index plane appears.

Figure 4:
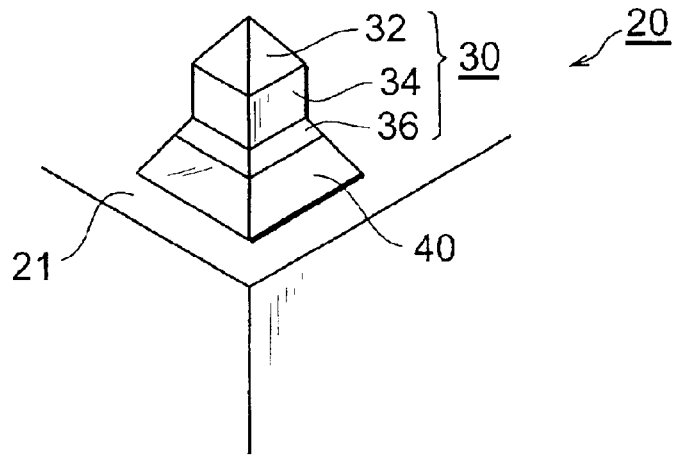
FIG. 4 is a perspective view showing a state where a Schottky junction is formed by depositing a gate electrode around the base portion of an electron-emitting portion in FIG. 3B.
Figure 5:
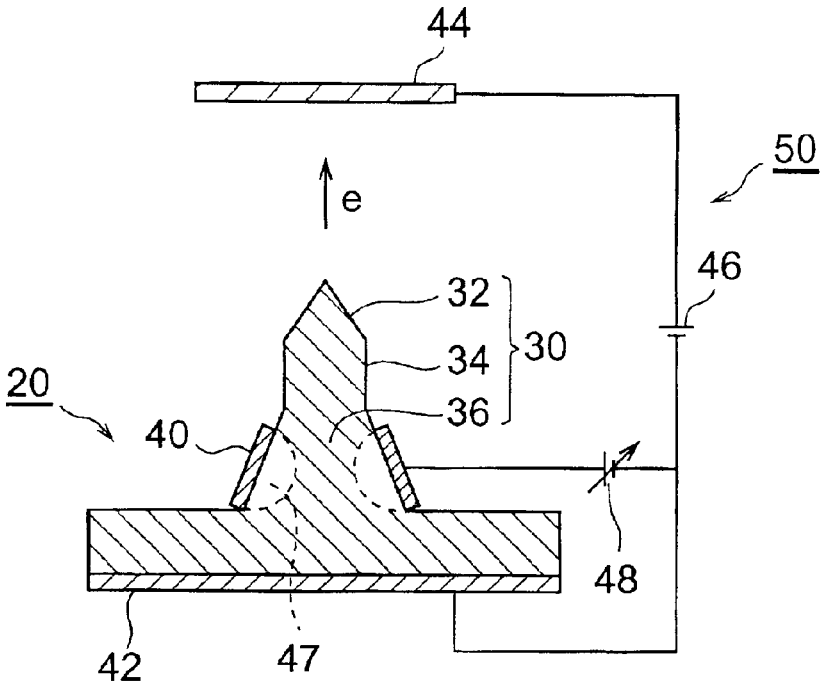
FIG. 5 is a view showing an electronic device obtained by mounting a cathode electrode and anode electrode (electron extraction electrode) on the electron-emitting element in FIG. 4.

FIG. 4 shows a Schottky junction formed by depositing an Al gate electrode 40 around the base portion 36 of the electron-emitting portion 30 in FIG. 3B. FIG. 5 shows an electronic device 50 formed by attaching a cathode electrode 42 and anode electrode (electron extraction electrode) 44 to the electron-emitting element 20. The anode electrode 44 is placed to oppose the sharp-pointed portion 32 of the electron-emitting portion 30. As shown in FIG. 5, a depletion layer 47 is formed inside the electron-emitting portion 30 around which the gate electrode 40 is mounted. A power supply 46 for electron emission is placed between the cathode electrode 42 and the anode electrode 44, and a power supply 48 is placed between the gate electrode 40 and the cathode electrode 42.

When the power supply 46 is turned on, a voltage is applied between the electron-emitting element 20 and the anode electrode 44, and electrons emitted from the sharp-pointed portion 32 of the electron-emitting portion 30 travel toward the anode electrode 44. Assume that the diamond of the electron-emitting portion 30 has been doped with boron or the like and has become p type. In this case, when the output level of the power supply 48 is raised to apply a positive bias to the gate electrode 40, the depletion layer 47 extends. As a consequence, the number of electrons emitted from the sharp-pointed portion 32 can be reduced. In contrast to this, when the bias voltage from the power supply 48 to the gate electrode 40 is lowered, the depletion layer 47 narrows. This makes it possible to increase the number of electrons emitted from the sharp-pointed portion 32. In this manner, by forming a Schottky junction on the base portion 36 which is flattened upon appearance of a low index plane, the number of electrons emitted from the electron-emitting portion 30 can be adjusted. Note that the gate electrode 40 may be formed around the intermediate portion 34 instead of the base portion 36 or may be formed around both the base portion 36 and the intermediate portion 34. If the diamond of the electron-emitting portion 30 is of the n type, the depletion layer 47 extends upon application of a negative voltage to the gate electrode 40.

Figure 6:
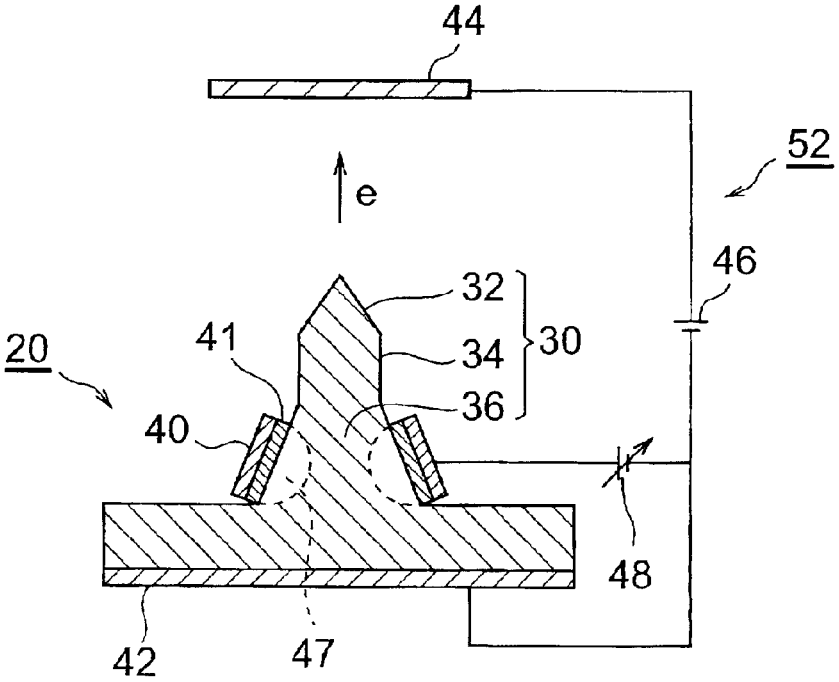
FIG. 6 is a view showing an electronic device having a MIS junction formed by depositing an insulating layer and gate electrode around the base portion.

FIG. 6 shows an electronic device 52 obtained by forming a MIS junction by depositing an $SiO_2$ insulating layer 41 and Al gate electrode 40 around the base portion 36 instead of the gate electrode 40 of the electronic device 50 in FIG. 5. When a MIS junction is formed in this manner as well, the number of electrons emitted from the sharp-pointed portion 32 can be increased/decreased by adjusting the output level of the power supply 48 and changing the size of the depletion layer 47.

[Second Embodiment]

A method of manufacturing an electron-emitting element according to the second embodiment of the present invention will be described next with reference to FIGS. 7A to 7F. In the steps shown in FIGS. 7A to 7D, the same processing as that in the steps shown in FIGS. 1A to 1D is performed to form a plurality of columnar member 25 on a substrate 21, as shown in FIGS. 7A to 7D.

Figure 7A:
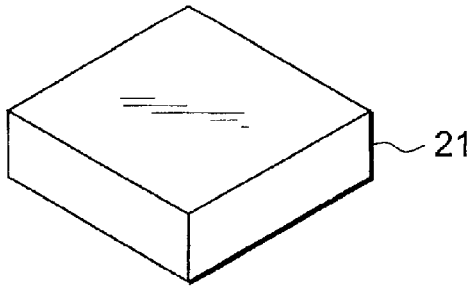
FIGS. 7A to 7F are perspective views showing the steps in a method of manufacturing an electron-emitting element according to the second embodiment of the present invention.
Figure 7D:
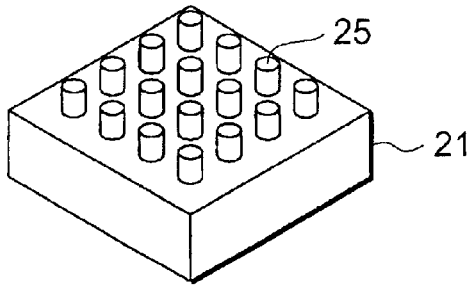
Figure 7B:
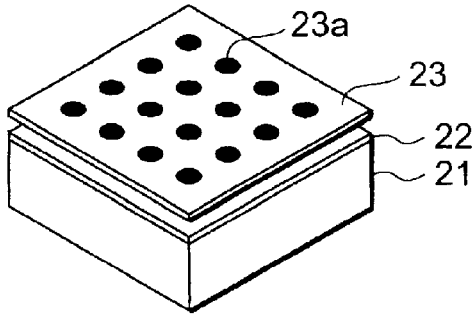
Figure 7E:
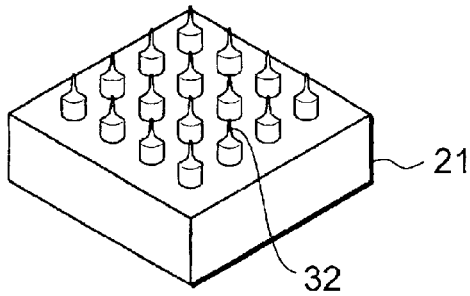
Figure 7C:
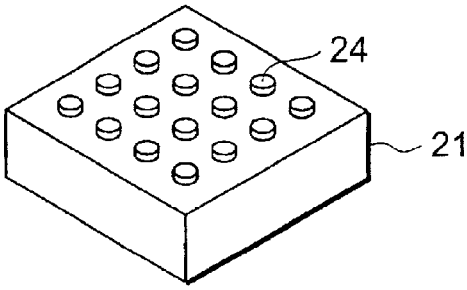

In the step shown in FIG. 7E, reactive ion etching is performed with respect to the columnar members 25 by using pure oxygen (100% oxygen) while the portions other than the columnar members 25 are masked with $SiO_2$ or Al, thereby forming needle-like sharp-pointed portions 32 on the distal ends of the columnar members 25. Acid treatment is further performed with respect to the sharp-pointed portions 32 to further sharpen the sharp-pointed portions 32.

Figure 7F:
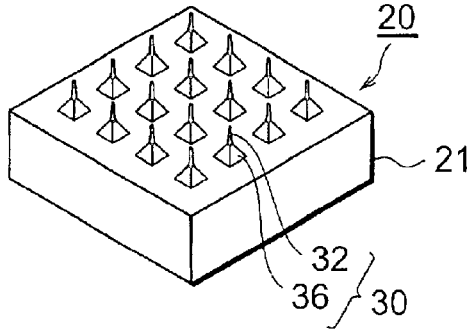
Figure 8:
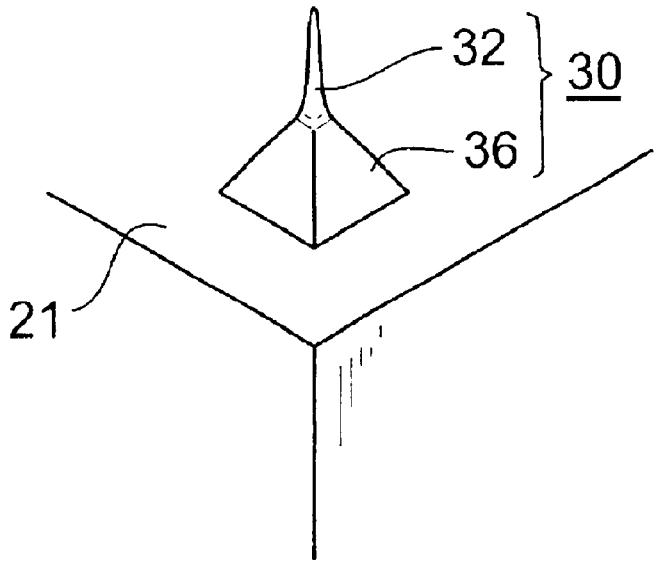
FIG. 8 is an enlarged view of an electron-emitting portion in FIG. 7F.

In the step shown in FIG. 7F, plasma etching is performed in a microwave plasma to form base portions 36 in the shape of a quadrangular pyramid, thus completing electron-emitting portions 30, each of which is shown in detail in FIG. 8. As clearly shown in FIG. 8, the electron-emitting portion 30 has the base portion 36 in the shape of a frustum of a quadrangular pyramid and the needle-like sharp-pointed portion 32 located closer to the distal end side than the base portion 36.

According to the method of manufacturing an electron-emitting element 20 of this embodiment, as in the first embodiment, the position of each electron-emitting portion 30 can be controlled by adjusting the place where each diamond columnar member 25 is formed. That is, the electron-emitting portion 30 can be formed at a desired position. In addition, the area of the base of the electron-emitting portion 30 formed by reactive ion etching depends on the area of the base of the columnar member 25 before etching, and the height of the electron-emitting portion 30 depends on the height of the columnar member 25 before etching and the type of etching. In addition, since the height and the area of the base of the columnar member 25 can be set to desired values by adjusting the conditions of etching for the formation of the electron-emitting portion 30, the area of the base and height of the electron-emitting portion 30 can be independently controlled unlike the case where the overall electron-emitting portion 30 is formed into a pyramidal shape by a diamond synthesis technique as in the prior art. For this reason, if the aspect ratio of each columnar member 25 is set to be high, the density of electron-emitting portions 30 in the electron-emitting element 20 can be increased without decreasing the height of each electron-emitting portion 30.

In this embodiment, after the sharp-pointed portion 32 is formed by reactive ion etching, acid treatment is performed to further sharpen the sharp-pointed portion 32. However, acid treatment including fluorine atoms, plasma treatment including fluorine atoms, or the like may be performed instead of the above treatment.

[Third Embodiment]

A method of manufacturing an electron-emitting element according to the third embodiment of the present invention will be described next with reference to FIGS. 9A to 9D. In the step shown in FIG. 9A, a circular Al mask portion 24 is formed on the surface of a substrate 21 made of monocrystalline diamond. In the step shown in FIG. 9B, the substrate 21 is etched in a gas with an $O_2$ content of almost 100% to form a columnar member 25. In this case, since the $O_2$ content of the etching gas is almost 100%, the etching rate in the lateral direction is much lower than that in the longitudinal direction. As a consequence, the columnar member 25 has a cylindrical shape.

Figure 9A:
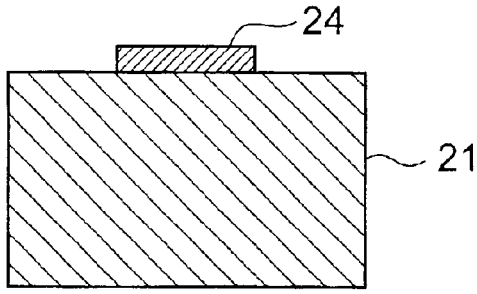
FIGS. 9A to 9D are sectional views showing the steps in a method of manufacturing an electron-emitting element according to the third embodiment of the present invention.
Figure 9B:
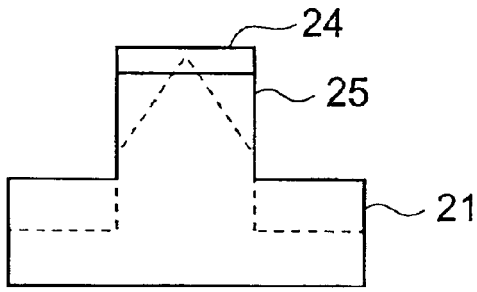
Figure 9C:
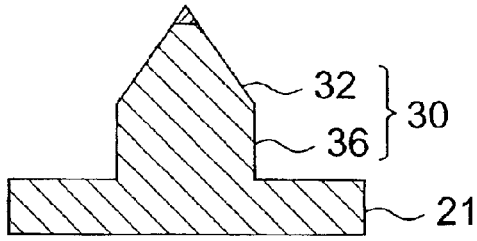

In the step shown in FIG. 9C, the columnar member 25 is etched in a gas containing $O_2$ and Ar. In this case, since the etching as contains Ar, the ratio of the etching rate in the lateral direction to the etching rate in the longitudinal direction increases as compared with the etching in the step in FIG. 9B. As a consequence, a frustoconical sharp-pointed portion 32 which has an inclined surface is formed on the upper portion of the columnar member 25. In this case, not only the substrate 21 but also the mask portion 24 is etched in the lateral direction. The lower portion of the sharp-pointed portion 32 on which no inclined surface is formed becomes the cylindrical base portion 36, thus forming an electron-emitting portion 30 having the sharp-pointed portion 32, and base portion 36. In the step shown in FIG. 9D, the remaining portion of the mask portion 24 is removed to complete the electron-emitting element 20 of this embodiment.

According to this embodiment, the position of the electron-emitting portion 30 can be controlled by adjusting the place where the mask portion 24 is formed in the step shown in FIG. 9A. The area of the base of the obtained electron-emitting portion 30 depends on the area of the base of the columnar member 25 obtained by the etching in the step in FIG. 9B, and the height of the electron-emitting portion 30 depends on the etching conditions in the steps shown in FIGS. 9B and 9C. The area of the base of the columnar member 25 can be controlled by adjusting the area of the mask portion 24. The height of the electron-emitting portion 30 can be controlled by adjusting the amount of a portion of the substrate 21 which is removed by the etching in FIG. 9B. Therefore, the height and the area of the base of the electron-emitting portion 30 can be independently controlled. Note that the columnar member 25 is not limited to a cylindrical shape and may be formed into a frustoconical shape.

Figure 9D:
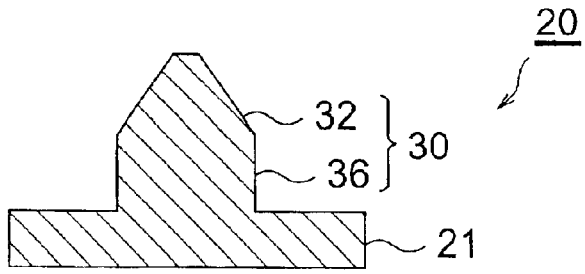
Figure 10A:
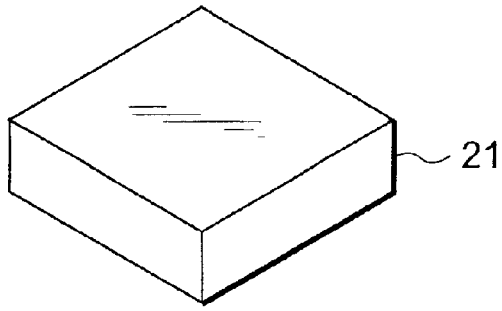
FIG. 10A to 10E are perspective views showing the steps in a method of manufacturing an electron-emitting element according to the fourth embodiment of the present invention.
Figure 10B:
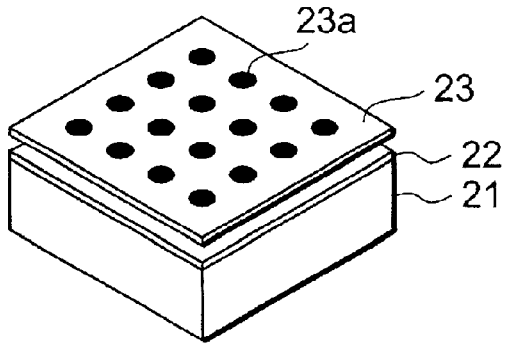
Figure 10C:
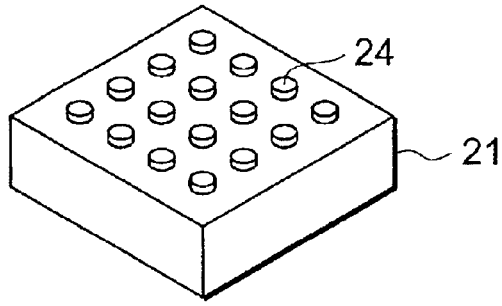
Figure 10D:
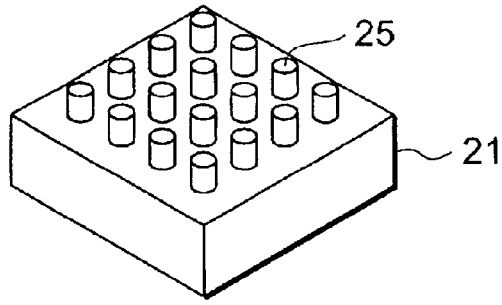
Figure 10E:
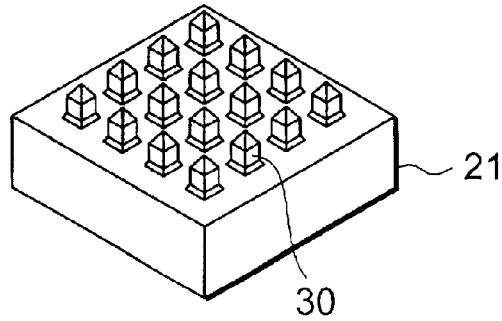

In the step shown in FIG. 9C, etching with the mask portion 24 being placed on the upper surface of the columnar member 25 makes the upper surface of the columnar member 25 resistant to cutting and makes it possible to sharpen the sharp-pointed portion 32. As shown in FIG. 9D, the top portion of the electron-emitting portion 30 is flat. However, such a portion is also called the sharp-pointed portion 32 in the present invention. In the step shown in FIG. 9C, by increasing the Ar content of the etching gas, the etching rate in the lateral direction can be increased. This makes it possible to sharpen the distal end of the sharp-pointed portion 32. In addition, if the etching time is controlled such that no Al is left which is side-etched or Al is slightly overetched in the lateral direction, the distal end of the sharp-pointed portion 32 can be sharpened. The etching gas in the step shown in FIG. 9C is not limited to the gas mixture of 02 and Ar, and any gas can be used as long as the ratio of the etching rate in the lateral direction to the etching rate in the longitudinal direction becomes higher than that in the etching in the step shown in FIG. 9B.

[Fourth Embodiment]

A method of manufacturing an electron-emitting element according to the fourth embodiment of the present invention will be described next with reference to FIGS. 10A to 10E. In the steps shown in FIGS. 10A to 10D, the same processing as that in the steps shown in FIGS. 1A to 1D is performed to form a plurality of columnar members 25 on a substrate 21. In the step shown in FIG. 10E, diamond is epitaxially grown by diamond synthesis processing using a microwave CVD method with the columnar members 25 serving as nuclei, thereby forming electron-emitting portions 30.

Figures 11, 12:
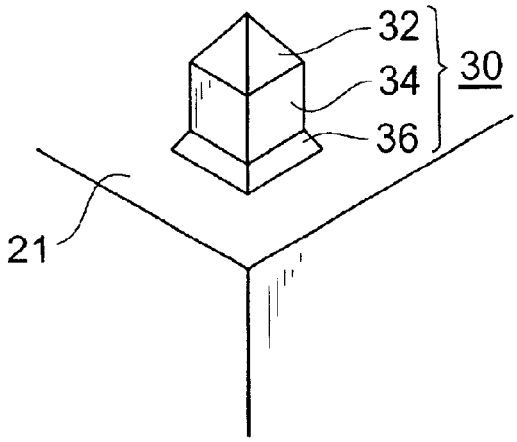
FIG. 11 is an enlarged view of an electron-emitting portion in FIG. 10E.
FIG. 12 is a view showing the dimensions of columnar members and electron-emitting portions in Example 1.

FIG. 11 is an enlarged perspective view of the electron-emitting portion 30. As shown in FIG. 11, the electron-emitting portion 30 is comprised of a base portion 36 in the shape of a frustum of quadrangular pyramid, the pyramidal sharp-pointed portion 32, and an intermediate portion 34 in the shape of a quadrangular prism which is located between the base portion 36 and the sharp-pointed portion 32 to connect them. To form the electron-emitting portion 30 having a three-tier structure including the base portion 36, intermediate portion 34, and sharp-pointed portion 32 in this manner, the columnar member 25 with an aspect ratio of 2 or more is formed, and diamond synthesis is performed under the condition that $CH_4$ (mol)/$O_2$ (mol) is 0.02 or less. Subsequently, diamond synthesis is performed under the conditions that $CH_4$ (mol)/$O_2$ (mol) is 0.03 or more and the temperature at a portion near the columnar member 25 is 900° C. or lower.

According to this embodiment, the position of the electron-emitting portion 30 can be controlled by adjusting the place where the columnar member 25 is formed. In addition, the electron-emitting portion 30 having the base portion 36, intermediate portion 34, and sharp-pointed portion 32 is formed by applying a microwave CVD method to the columnar member 25. The area of the base of the obtained electron-emitting portion 30 depends on the shape of the columnar member 25 before the execution of the microwave CVD method, and the height of the electron-emitting portion 30 depends on the shape of the columnar member 25 before the execution of the microwave CVD method and the conditions of the microwave CVD method. In addition, the height and the area of the base of the columnar member 25 can be set to desired values by adjusting the conditions of etching. Therefore, the area of the base and height of the electron-emitting portion 30 can be independently controlled unlike the case where the overall electron-emitting portion is formed into a pyramidal shape by a diamond synthesis technique as in the prior art.

EXAMPLES

The present invention will be described in more detail next with reference to the following examples.

Example 1

This example corresponds to the first embodiment. First of all, fine circular Al masks were two-dimensionally formed on a (100) substrate made of Ib monocrystalline diamond by a photolithographic technique. Reactive ion etching was then performed with respect to the substrate in (a) a gas with a composition of $CF_4$ (mol)/$O_2$ (mol)=0.001 at 5.33 Pa and 200 W or in (b) a gas with a composition of $CF_4$ (mol)/$O_2$ (mol)=0.025 at 5.33 Pa and 30 W for 0.5 to 2 hrs, thereby forming columnar members (cylinders). A total of seven columnar members were formed. The table in FIG. 12 shows the dimensions of the respective columnar members. The height of each columnar member was controlled by changing the ratio of $CF_4$ (mol)/$O_2$ (mol) and the etching time. The columnar members having heights of 5 $\mu$m or more were formed under the conditions (a), whereas the columnar members having heights of less than 5 $\mu$m were formed under the conditions (b).

After the columnar members were formed, plasma etching was performed with respect to the columnar members in a gas with a composition of $CO_2$ (mol)/$H_2$ (mol)=0.005 and at a substrate temperature of 1,050° C., a pressure of 13.3 kPa, and a microwave power of 400 W for 4 hrs. As a result, electron-emitting portions were obtained, each of which had a base portion whose shape depended on the plane azimuth of the substrate and a sharp-pointed portion located closer to the distal end side than the base portion. The aspect ratio of each electron-emitting portion was made to fall within the range of 1 to 2.3, as shown in FIG. 12. As a consequence, in the present invention, it was found that the height and the area of the base of each electron-emitting portion could be independently and arbitrarily controlled, unlike the prior art, in which only the aspect ratio of each pyramidal electron-emitting portion could be controlled to about 0.7.

Figure 13A:
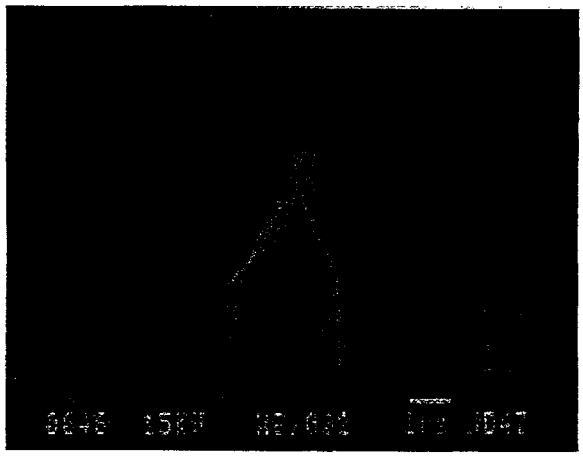
FIGS. 13A to 13C are photomicrographs of electron-emitting elements obtained in Example 1.
Figure 13B:
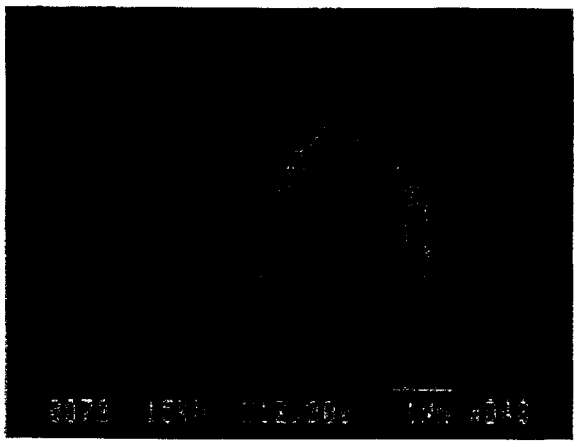
Figure 13C:
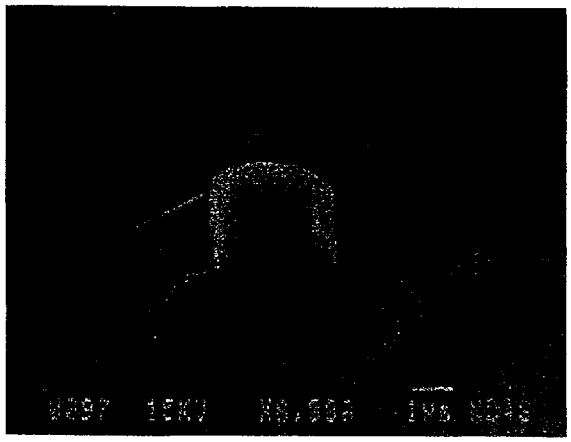

FIGS. 13A to 13C show photomicrographs of the obtained electron-emitting elements. The electron-emitting portion shown in FIG. 13A has an aspect ratio of 2.3. The electron-emitting portion shown in FIG. 13B has an aspect ratio of 1.4. The electron-emitting portion shown in FIG. 13C has an aspect ratio of 1.

Example 2

This example corresponds to the second embodiment. Al mask portions were formed on a (100) substrate made of Ib monocrystalline diamond by a photolithographic technique. Reactive ion etching was then performed with respect to the substrate in a gas with a composition of $CF_4$ (mol)/$O_2$ (mol)=0.001 at 5.33 Pa and 200 W for 0.5 hrs, thereby forming columnar members (cylinders). Portions of the substrate other than the portions on which columnar members were formed were masked with Al, and reactive ion etching was performed with respect to the columnar members with 100% oxygen to form electron-emitting portions each having a needle-like sharp-pointed portion and base portion. The sharp-pointed portions were then sharpened by hydrofluoric acid treatment.

Figure 14A:
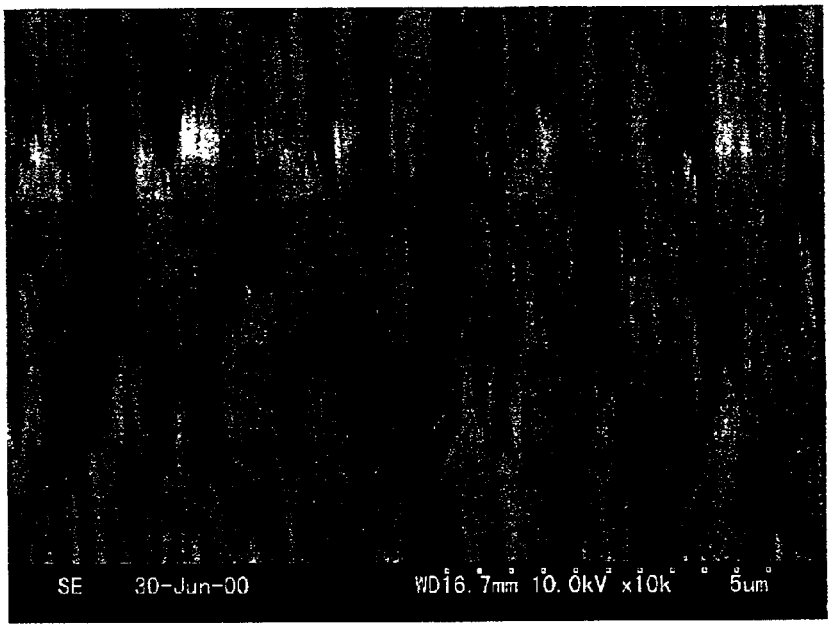
FIGS. 14A and 14B are photomicrographs of an electron-emitting element obtained in Example 2.
Figure 14B:
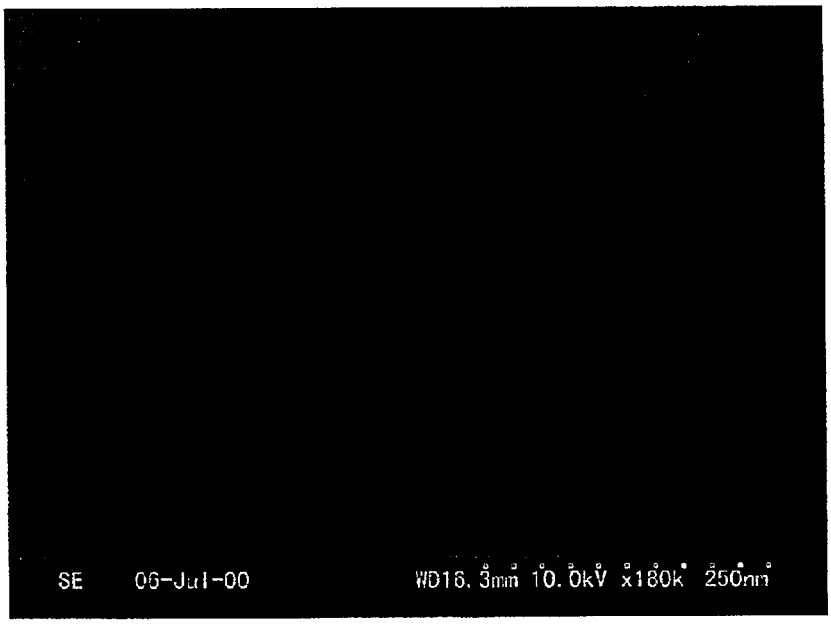

FIGS. 14A and 14B show photomicrographs of the sharp-pointed portions of the obtained electron-emitting portions. FIG. 14A shows a photomicrograph at a low magnification. FIG. 14B shows a photomicrograph at a high magnification. As is obvious from these photomicrographs, the sharp-pointed portion were sharpened into needle-like shapes. Note that with the use of a columnar member having a diameter of 1 $\mu$m or more, a plurality of needle-like sharp-pointed portions could be formed on one electron-emitting portion.

Example 3

Like Example 2, this example corresponds to the second embodiment. Al mask portions were formed on a (100)

substrate made of Ib monocrystalline diamond by a photolithographic technique. Reactive ion etching was then performed with respect to the substrate in a gas with a composition of $CF_4$ (mol)/$O_2$ (mol)=0.001 at 5.33 Pa and 200 W for 0.5 hrs, thereby forming columnar members (cylinders). Portions of the substrate other than the portions on which columnar members were formed were masked with Al, and reactive ion etching was performed with respect to the columnar members with 100% oxygen to form electron-emitting portions each having a needle-like sharp-pointed portion and base portion. Thereafter, plasma etching was performed with respect to the electron-emitting portions in a gas with a composition of $CO_2$ (mol)/$H_2$ (mol)=0.05 at a substrate temperature of 1,080° C., a pressure of 13.3 kPa, and a microwave power of 400 W.

Figure 15A:
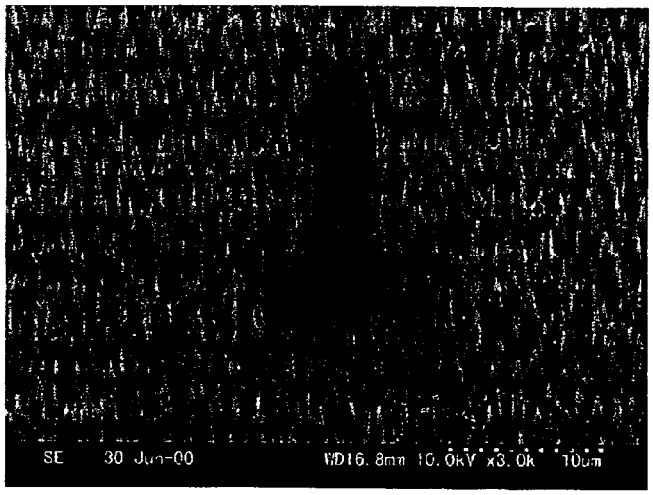
FIGS. 15A to 15C are photomicrographs of an electron-emitting element obtained in Example 3.
Figure 15B:
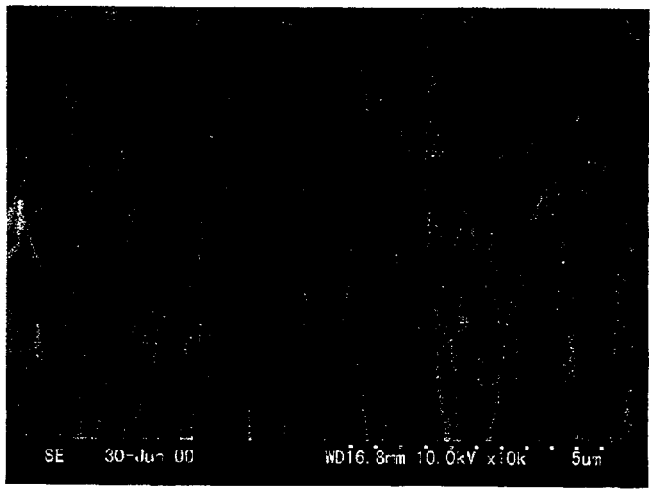
Figure 15C:
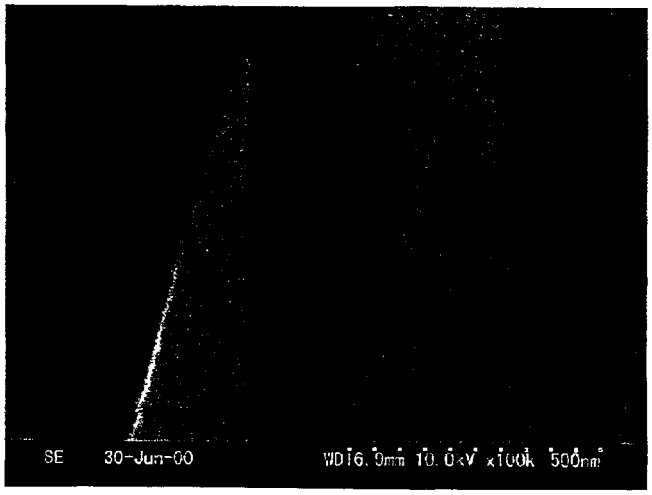

FIGS. 15A to 15C are photomicrographs of the obtained electron-emitting element. FIG. 15A is a photomicrograph of the entire electron-emitting portion. FIG. 15B is a photomicrograph of the sharp-pointed portion at a low magnification. FIG. 15C is a photomicrograph of the sharp-pointed portion at a high magnification. As is obvious from the photomicrograph of FIG. 15C, the distal end of the sharp-pointed portion was considerably sharpened.

Example 4

Figure 16A:
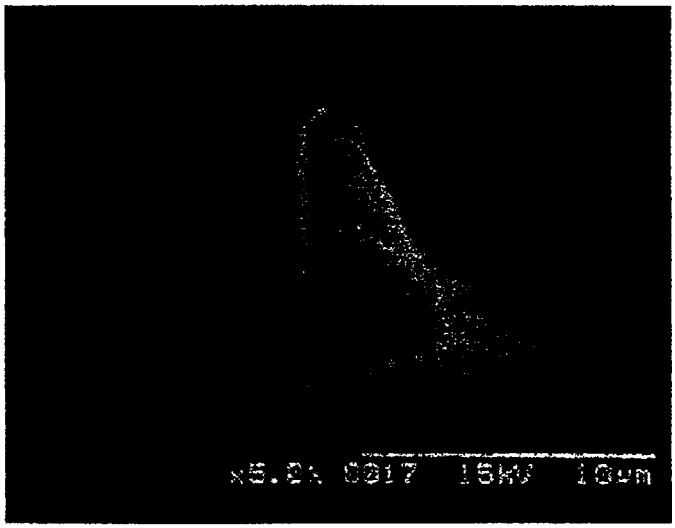
FIGS. 16A and 16B are photomicrographs of electron-emitting elements obtained in Example 4.

This example corresponds to the third embodiment. Al mask portions were formed on a (100) substrate made of Ib monocrystalline diamond by a photolithographic technique. Reactive ion etching was then performed with respect to the substrate in a gas with a composition of $CF_4$ (mol)/$O_2$ (mol)=0.001 at 5.33 Pa and 200 W for 0.5 hrs, thereby forming columnar members (cylinders). When the columnar members were etched in a gas with a composition of Ar (mol)/$O_2$ (mol)=1, an electron-emitting portion shown in the photomicrograph of FIG. 16A could be obtained. As is obvious from this photomicrograph, a base portion was formed at the root portion of the electron-emitting portion, and a sharp-pointed portion was formed on the distal end side.

Figure 16B:
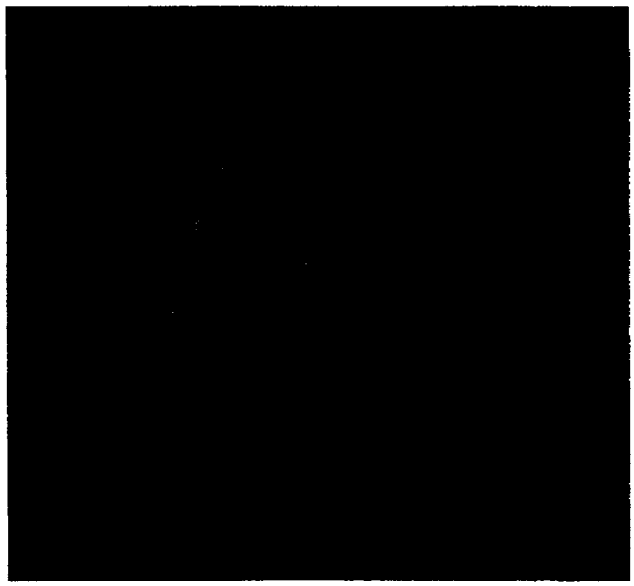

When each columnar member was etched by using a 100% Ar gas in place of the etching gas with a composition of Ar (mol)/$O_2$ (mol)=1, the electron-emitting portion shown in the photomicrograph of FIG. 16B could be obtained. As is obvious from this photomicrograph, the distal end of the sharp-pointed portion of the electron-emitting portion formed by an etching gas with a high Ar content was sharper than that of the sharp-pointed portion in FIG. 16A. When an etching gas with a composition of Ar (mol)/$O_2$ (mol)=1 was used, the distal end of each sharp-pointed portion was sharpened as in the case where 100% Ar was used as an etching gas, by prolonging the etching time.

Example 5

This example corresponds to the fourth embodiment. First of all, Al mask portions were formed on three substrates, i.e., a (100) substrate, (110) substrate, and (111) substrate, each of which was made of Ib monocrystalline diamond, by a photolithographic technique. Reactive ion etching was performed with respect to each substrate in a gas with a composition of $CF_4$ (mol)/$O_2$ (mol)=0.001 at 5.33 Pa and 200 W to form columnar members (cylinders) each having an aspect ratio of 2.

Figure 17A:
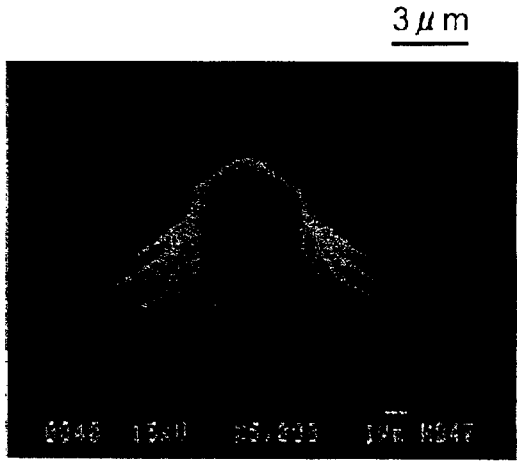
FIGS. 17A to 17C are photomicrographs of electron-emitting elements obtained in Example 5.

Diamond synthesis was performed by using the columnar members as nuclei in a gas with a composition of $CH_4$ (mol)/$H_2$ (mol)=0.045 and $CO_2$ (mol)/$H_2$ (mol)=0.005 at a substrate temperature of about 1,050° C., a pressure of 13.3 kPa, and a microwave power of 400 W for 30 min. As a result, an electron-emitting portion having a base portion, intermediate portion, and sharp-pointed portion was formed, as indicated by the photomicrograph of FIG. 17A. Note that FIG. 17A shows a photomicrograph indicating a electron-emitting portion formed by using the (100) substrate.

Figure 17B:
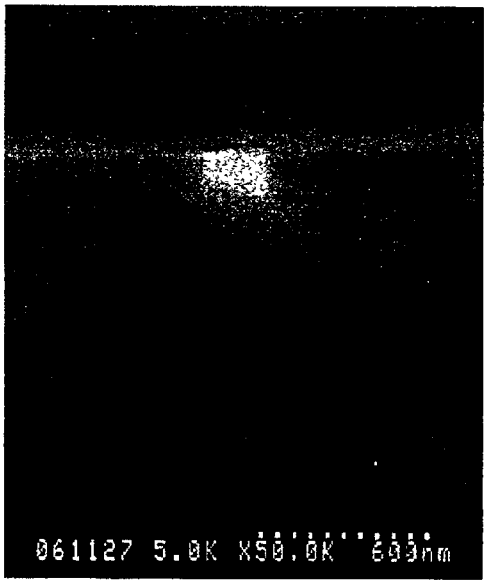

The growth of samples on the (110) substrate was stopped. On the (100) substrate, diamond synthesis was performed by using columnar members as nuclei in a gas with composition of $CH_4$ (mol)/$H_2$ (mol)=0.08 and $CO_2$ (mol)/$H_2$ (mol)=0.005 at a substrate temperature of about 900° C., a pressure of 8.0 kPa, and microwave power of 300 W for 60 min. FIG. 17B is a photomicrograph showing the obtained electron-emitting portion, taken from a side.

Figure 17C:
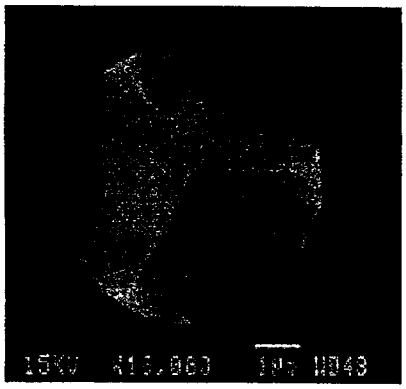
Figure 18:
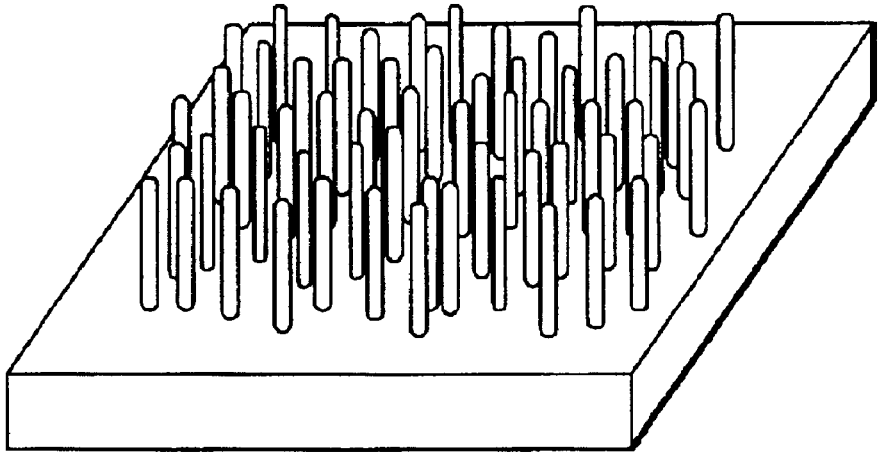
FIG. 18 is a perspective view showing a conventional electron-emitting element having a needle-like structure.
Figure 19:
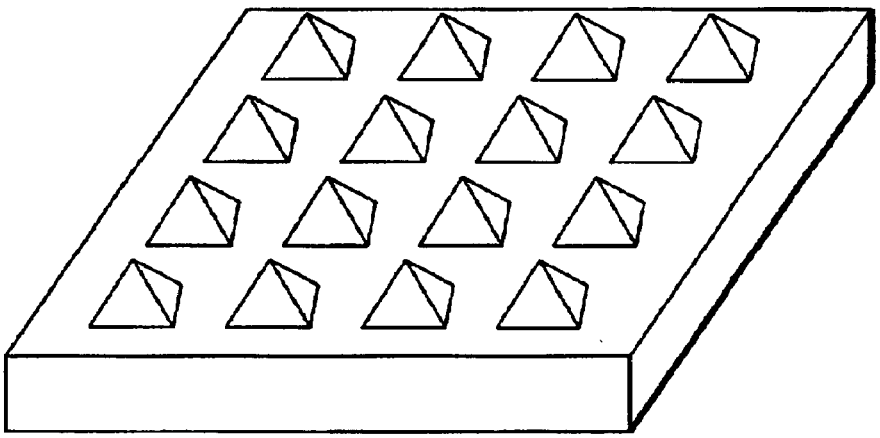
PRIOR ART Fig.19
FIG. 19 is a perspective view showing a conventional electron-emitting element having a pyramidal structure.

On the (111) substrate, diamond synthesis was performed by using columnar members as nuclei in a gas with a composition of $CH_4$ (mol)/$H_2$ (mol) 0.0015 at a substrate temperature of about 1,050° C., a pressure of 13.3 kPa, and a microwave power of 400 W for 4 hrs. FIG. 17C is a photomicrograph showing the obtained electron-emitting portion 30, taken from above.

By adding a condition of $B_2H_6/H_2=1000\times10^{-6}$ to an etching gas, conductive diamond could be synthesized, and currents could be made to flow in the electron-emitting element.

The examples of the present invention made by the present inventors have been described above on the basis of the embodiments. However, the present invention is not limited to the respective embodiments. For example, electronic devices that can emit electrons from sharp-pointed portions toward electron extraction electrodes can be formed even with the electron-emitting elements formed in the second to fourth embodiments by placing to make the electron extraction electrodes oppose the sharp-pointed portions. In addition, a Schottky junction or MIS junction can be formed by forming a metal gate electrode around each base portion of such an electronic device on which a low index plane appears. This makes it possible to adjust the number of electrons emitted.

As has been described above, according to the method of manufacturing an electron-emitting element of the present invention, the position of each electron-emitting portion can be controlled by adjusting the place where a diamond columnar member is formed. An electron-emitting portion having a sharp-pointed portion on its distal end is formed by etching a columnar member. The area of the base of the completed electron-emitting portion depends on the area of the base of the columnar member before etching. The height of the electron-emitting portion depends on the height of the columnar member before etching and the type of etching. In addition, since the height and the area of the base of the columnar member can be set to desired values by adjusting the conditions of etching, the area of the base and height of the electron-emitting portion can be independently controlled unlike the case where the overall electron-emitting portion is formed into a pyramidal shape by a diamond synthesis technique as in the prior art.

In addition, according to another method of manufacturing an electron-emitting element of the present invention, the position of each electron-emitting portion can be controlled by adjusting the place where a diamond columnar member is formed. An electron-emitting portion having a base portion, intermediate portion, and sharp-pointed portion is formed by performing diamond synthesis processing with respect to a columnar member. The area of the base of the obtained electron-emitting portion depends on the shape of the columnar member before diamond synthesis processing. The height of the electron-emitting portion depends on the shape of the columnar member before diamond synthesis processing and the conditions of diamond synthesis processing. In addition, since the height and the area of the base of the columnar member can be set to desired values by adjusting the conditions of etching, the area of the base and height of the electron-emitting portion can be independently controlled unlike the case where the overall electron-emitting portion is formed into a pyramidal shape by a diamond synthesis technique as in the prior art.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An electronic device comprising:

an electron-emitting element manufactured by a method comprising:

the first step of forming a monocrystalline diamond columnar member on a diamond substrate; and the second step of forming an electron-emitting portion having a base portion and a sharp-pointed portion which is located closer to a distal end side than the base portion and emits the electrons by performing etching processing with respect to the columnar member; and an electron extraction electrode placed to oppose the sharp-pointed portion, with a voltage being applied between said electron extraction electrode and said electron-emitting element, wherein the electron emitting portion has a polygonal cross section and a further intermediate portion located between the base portion and the sharp-pointed portion.

2. A device according to claim 1, further comprising:

a metal gate electrode formed around the base portion of said electron-emitting element; and a power supply for applying a voltage to said gate electrode.

3. A device according to claim 1, wherein the base portion is in the shape of a pyramid, and the intermediate portion is in the shape of a prism.

4. An electronic device comprising:

an electron-emitting element manufactured by a method comprising:

the first step of forming a monocrystalline diamond columnar member on a diamond substrate; and the second step of forming an electron-emitting portion having a base portion, a sharp-pointed portion for emitting the electrons, and a columnar intermediate portion located between the base portion and the sharp-pointed portion by performing diamond synthesis processing with respect to the columnar member; and an electron extraction electrode placed to oppose the sharp-pointed portion, with a voltage being applied between said electron extraction electrode and said electron-emitting element, wherein the electron emitting portion has a polygonal cross section and a further intermediate portion located between the base portion and the sharp-pointed portion.

5. A device according to claim 4, wherein the base portion is in the shape of a pyramid, and the intermediate portion is in the shape of a prism.

* * * * *